US008359720B2

(12) United States Patent
Dorsey et al.

(10) Patent No.: US 8,359,720 B2
(45) Date of Patent: Jan. 29, 2013

(54) HYDRAULIC PATTERNING OF A FIBROUS, SIDED NONWOVEN WEB

(75) Inventors: Kyra Dorsey, Vernon, CT (US); Gordon D Meikle, Duns (GB)

(73) Assignee: Ahlstrom Corporation, Helsinki (FI)

( * ) Notice: Subject to any disclaimer, the term of this patent is extended or adjusted under 35 U.S.C. 154(b) by 590 days.

(21) Appl. No.: 12/527,277

(22) PCT Filed: Feb. 15, 2008

(86) PCT No.: PCT/FI2008/050068

§ 371 (c)(1),
(2), (4) Date: Jan. 13, 2010

(87) PCT Pub. No.: WO2008/099066

PCT Pub. Date: Aug. 21, 2008

(65) Prior Publication Data

US 2010/0130086 A1 May 27, 2010

Related U.S. Application Data

(60) Provisional application No. 60/890,089, filed on Feb. 15, 2007.

(51) Int. Cl.
*D04H 5/02* (2012.01)

(52) U.S. Cl. ..... 28/104

(58) Field of Classification Search ..... 28/104, 28/105, 106, 103, 167; 264/555, 557, 210.8, 264/211.13, 211.14
See application file for complete search history.

(56) References Cited

U.S. PATENT DOCUMENTS

| | | | | | |
|---|---|---|---|---|---|
| 3,113,349 | A | * | 12/1963 | Nottebohm et al. | 264/119 |
| 3,787,932 | A | * | 1/1974 | Kalwaites | 28/105 |
| 3,917,785 | A | * | 11/1975 | Kalwaites | 264/108 |
| 4,591,513 | A | * | 5/1986 | Suzuki et al. | 427/200 |
| 4,665,597 | A | * | 5/1987 | Suzuki et al. | 28/104 |
| 4,718,152 | A | | 1/1988 | Suzuki et al. | |
| 4,805,275 | A | * | 2/1989 | Suzuki et al. | 28/104 |
| 5,301,401 | A | * | 4/1994 | Suzuki et al. | 28/167 |
| 5,632,072 | A | | 5/1997 | Simon et al. | |
| 5,983,469 | A | * | 11/1999 | Beaty et al. | 28/167 |
| 6,295,706 | B1 | * | 10/2001 | Strahm | 28/167 |
| 2005/0202744 | A1 | | 9/2005 | Putnam et al. | |
| 2006/0191115 | A1 | | 8/2006 | Carter et al. | |

FOREIGN PATENT DOCUMENTS

| | | |
|---|---|---|
| EP | 0 560 556 | 9/1993 |
| WO | WO 2004/063451 | 7/2004 |

OTHER PUBLICATIONS

International Search Report for PCT/FI2008/050068 mailed Jun. 25, 2008.
Written Opinion for PCT/FI2008/050068 mailed Jun. 25, 2008.
International Preliminary Report on Patentability mailed May 11, 2009.

* cited by examiner

*Primary Examiner* — Amy Vanatta
(74) *Attorney, Agent, or Firm* — Nixon & Vanderhye P.C.

(57) ABSTRACT

Disclosed herein is a reflectively patterned, fibrous, sided nonwoven material comprising a first set of fibers hydraulically needled with a web of a second set of fibers, the first set of fibers primarily containing short fibers and the second set of fibers primarily containing one of (a) substantially continuous filaments, (b) long fibers, and (c) short fibers having an average fiber length at least twice the average fiber length of the first set of fibers. The material has a first surface predominately comprising the first set of fibers and an opposing second surface predominately comprising the second set of fibers. A method of patterning a sided nonwoven web and a reflectively patterned, sided nonwoven material also are disclosed.

12 Claims, 6 Drawing Sheets

HYDRAULIC PATTERNING OF A FIBROUS, SIDED NONWOVEN WEB

This application is the U.S. national phase of International Application No. PCT/FI2008/050068 filed 15 Feb. 2008 which designated the U.S. and claims priority to U.S. Provisional Application No. 60/890,089 filed 15 Feb. 2007, the entire contents of each of which are hereby incorporated by reference.

FIELD

The present invention relates to a patterned nonwoven material and the method of patterning the nonwoven. Especially, the present invention relates to sided and fibrous patterned nonwovens, and their manufacture.

BACKGROUND

The use of high pressure jets to entangle fibers in a nonwoven web, sometimes called hydroentangling, hydraulic needling or spunlacing, is known. Typically, these processes are used with carded nonwoven webs, although there is some hydraulic needling of wet laid nonwoven webs and spunbonded nonwoven webs. These processes support the nonwoven web on a highly porous member such as a mesh belt or a metal screen so that the high pressure fluid can pass through the nonwoven web and continue through the porous member for collection. A negative pressure (vacuum) is typically applied to the porous member to help draw fluid from the nonwoven web through the support member.

It is known to produce a patterned nonwoven fabric having entangled nonwoven fibers. U.S. Pat. No. 4,718,152 is directed to a method for production of patterned nonwoven fabric in which a fibrous web is subjected to high energy treatment with high velocity water streams not only for entangling the fiber but also for patterning the fibrous web. This latter process is sometimes called hydropatterning. The fiber entangling treatment is performed on a plurality of non-porous supports arranged in a multi-stage manner at regular intervals along the path of the fibrous web. The patterning treatment is performed on a separate non-porous support arranged downstream of the non-porous supports upon which fiber entangling takes place. For the precursor webs described in this patent, both sides of the web are the same.

It would be useful to provide an improved patterned nonwoven material and an efficient method for its production. In particular, it would be useful to provide sided nonwovens which are often preferred as wiping substrates.

SUMMARY

An object of the present invention is to develop a reflectively patterned, fibrous, sided nonwoven material comprising a first set of fibers hydraulically needled with a web of a second set of fibers, the first set of fibers primarily containing short fibers and the second set of fibers primarily containing one of (a) substantially continuous filaments, (b) long fibers, and (c) short fibers having an average fiber length at least twice the average fiber length of the first set of fibers, the material having a first surface predominately comprising the first set of fibers and an opposing second surface predominately comprising the second set of fibers.

Another object of the present invention is to develop a method of reflectively patterning a nonwoven web, comprising providing a sided nonwoven web comprising a first set of fibers hydraulically needled with a web of a second set of fibers, the first set of fibers primarily containing short fibers and the second set of fibers primarily containing one of (a) substantially continuous filaments, (b) long fibers, and (c) short fibers having an average fiber length at least twice the average fiber length of the first set of fibers, the sided nonwoven web having a first surface predominately comprising the first set of fibers and an opposing second surface predominately comprising the second set of fibers, disposing the nonwoven web between a surface of a patterned support and a hydraulic needling manifold so that one of the first surface and the second surface is oriented toward the hydraulic needling manifold and the other of the first surface and the second surface is oriented toward the support surface, and discharging fluid from the hydraulic needling manifold to rearrange fibers on at least one of the first and second surfaces. Some of the fluid discharged from the hydraulic needling manifold passes through the nonwoven web to impact the support surface, and some of the fluid discharged from the hydraulic needling manifold that impacts the support surface is reflected into the surface of the nonwoven web that is oriented toward the support surface.

A still further object of the present invention is to provide a reflectively patterned composite nonwoven material. Preferably, the reflectively patterned composite nonwoven material includes a plurality of short fibers overlying and entangled into a nonwoven web comprising substantially continuous thermoplastic filaments. The reflectively patterned composite nonwoven material would be advantageous as a wiping substrate.

Yet one more object of the present invention is to develop a reflectively patterned composite nonwoven material. Preferably, the reflectively patterned composite nonwoven material includes a plurality of short fibers overlying and hydraulically needled into a nonwoven web comprising hydroentangled carded staple fibers. The reflectively patterned composite nonwoven material would be advantageous as a wiping substrate.

Briefly, still one more object of the present invention is to provide a reflectively patterned wet laid nonwoven material. The reflectively patterned composite nonwoven material would be advantageous as a wipe material.

In general, unless otherwise explicitly stated the disclosed materials and processes may be alternately formulated to comprise, consist of, or consist essentially of, any appropriate components, moieties or steps herein disclosed. The disclosed materials and processes may additionally, or alternatively, be formulated so as to be devoid, or substantially free, of any components, materials, ingredients, adjuvants, moieties, species and steps used in the prior art compositions or that are otherwise not necessary to the achievement of the function and/or objective of the present disclosure.

When the word "about" is used herein it is meant that the amount or condition it modifies can vary some beyond the stated amount so long as the function and/or objective of the disclosure are realized. The skilled artisan understands that there is seldom time to fully explore the extent of any area and expects that the disclosed result might extend, at least somewhat, beyond one or more of the disclosed limits. Later, having the benefit of this disclosure and understanding the concept and embodiments disclosed herein, a person of ordinary skill can, without inventive effort, explore beyond the disclosed limits and, when embodiments are found to be without any unexpected characteristics, those embodiments are within the meaning of the term about as used herein.

DEFINITIONS

Bicomponent fiber—A fiber that has been formed by extruding polymer sources from separate extruders and spun together to form a single fiber. Typically, two separate polymers are extruded, although a bicomponent fiber may encompass extrusion of the same polymeric material from separate extruders. The extruded polymers are arranged in substantially constantly positioned distinct zones across the cross-section of the bicomponent fibers and extend substantially continuously along the length of the bicomponent fibers. The configuration of bicomponent fibers can be symmetric (e.g., sheath:core or side:side) or they can be asymmetric (e.g., offset core within sheath; crescent moon configuration within a fiber having an overall round shape). The two polymer sources may be present in ratios of, for example (but not exclusively), 75/25, 50/50 or 25/75.

Biconstituent fiber—A fiber that has been formed from a mixture of two or more polymers extruded from the same spinneret. Biconstituent fibers do not have the various polymer components arranged in relatively constantly positioned distinct zones across the cross-sectional area of the fiber and the various polymers are usually not continuous along the entire length of the fiber, instead usually forming fibrils which start and end at random. Biconstituent fibers are sometimes also referred to as multiconstituent fibers.

Binder—An adhesive material used to bind a web of fibers together or bond one web to another. The principal properties of a binder are adhesion and cohesion. The binder can be in solid form, for example a powder, film or fiber, in liquid form, for example a solution, dispersion or emulsion or in foam form.

Calendering—the process of smoothing the surface of the paper, nonwoven or textile sheet by pressing it between opposing surfaces. The opposing surfaces include flat platens and rollers. Either or both of the opposing surfaces may be heated.

Card—A machine designed to separate individual fibers from a mass of fiber, to align the fibers and deliver the aligned fibers as a batt or web. The fibers in the web can be aligned randomly or parallel with each other predominantly in the machine direction. The card consists of a series of rolls and drums that are covered with a plurality of projecting wires or metal teeth.

Carded web—A nonwoven web of fibers produced by carding.

Carding—A process for making nonwoven webs on a card.

Cellulose fiber—A fiber comprised substantially of cellulose. Cellulosic fibers come from manmade sources (for example, regenerated cellulose fibers or lyocell fibers) or natural sources such as cellulose fibers or cellulose pulp from woody and non-woody plants. Woody plants include, for example, deciduous and coniferous trees. Non-woody plants include, for example, cotton, flax, esparto grass, kenaf, sisal, abaca, milkweed, straw, jute, hemp, and bagasse.

Cellulose material—A material comprised substantially of cellulose. The material may be a fiber or a film. Cellulosic materials come from manmade sources (for example, regenerated cellulose films and fibers) or natural sources such as fibers or pulp from woody and non-woody plants.

Conjugate fiber—Fiber that has been formed by extruding polymer sources from separate extruders and spun together to form a single fiber. A conjugate fiber encompasses the use of two or more separate polymers each supplied by a separate extruder. The extruded polymers are arranged in substantially constantly positioned distinct zones across the cross-section of the conjugate fiber and extend substantially continuously along the length of the conjugate fiber. The shape of the conjugate fiber can be any shape that is convenient to the producer for the intended end use, e.g., round, trilobal, triangular, dog bone shaped, flat or hollow.

Cross machine direction (CD)—The direction perpendicular to the machine direction.

Cut fiber—A fiber that has been formed at, or cut to, a length. Cut fibers include, for example, shortcut fibers and staple fibers.

Denier—A unit used to indicate the fineness of a filament given by the weight in grams for 9,000 meters of filament. A filament of 1 denier has a mass of 1 gram for 9,000 meters of length.

Fiber—A material form characterized by an extremely high ratio of length to diameter. As used herein, the terms fiber and filament are used interchangeably unless otherwise specifically indicated.

Long fiber—A fiber having an average length of at least 25 mm and up to about 200 mm or more. One type of long fibers, referred as 'staple fibers', are normally made into a web by carding.

Lyocell—Manmade cellulose material obtained by the direct dissolution of cellulose in an organic solvent without the formation of an intermediate compound and subsequent extrusion of the solution of cellulose and organic solvent into a coagulating bath.

Machine direction (MD)—The direction of travel of the forming surface onto which fibers are deposited during formation of a nonwoven web material.

Meltblown fiber—A fiber formed by extruding a molten thermoplastic material as filaments from a plurality of fine, usually circular, die capillaries into a high velocity gas (e.g. air) stream which attenuates the filaments of molten thermoplastic material to reduce their diameter. Thereafter, the meltblown fibers are carried by the high velocity gas stream and are deposited on a collecting surface to form a web of randomly dispersed meltblown fibers. The meltblown process includes the meltspray process. Meltblown fibers can be short fibers, long fibers, or substantially continuous filaments.

Non-thermoplastic polymer—Any polymer material that does not fall within the definition of thermoplastic polymer.

Nonwoven fabric, sheet or web—A material having a structure of individual fibers which are interlaid, but not in an identifiable manner as in a woven or knitted fabric. Nonwoven materials have been formed from many processes such as, for example, meltblowing, spin laying, carding, air laying and water laying processes. The basis weight of nonwoven materials is usually expressed in weight per unit area, for example in grams per square meter (gsm or $g/m^2$) or ounces per square yard (1 osy=33.9 gsm). As used herein a nonwoven sheet includes a wetlaid paper sheet.

Polymer—A long chain of repeating, structural units. Generally includes, for example, homopolymers, copolymers, such as for example, block, graft, random and alternating copolymers, terpolymers, etc, and blends and modifications thereof. Furthermore, unless otherwise specifically limited, the term "polymer" includes all possible geometrical configurations. These configurations include, for example, isotactic, syndiotactic and random symmetries.

Reflectively patterned nonwoven—a patterned nonwoven made by a process in which fluid such as water is jetted onto a nonwoven, impinges a support for the nonwoven, and is reflected away from the support back to the nonwoven.

Regenerated cellulose—Manmade cellulose obtained by chemical treatment of natural cellulose to form a soluble chemical derivative or intermediate compound and subsequent decomposition of the derivative to regenerate the cellulose. Regenerated cellulose includes spun rayon and cellophane film. Regenerated cellulose processes include the viscose process, the cuprammonium process and saponification of cellulose acetate.

Short fiber—A fiber that has been formed at, or cut to, a length of 0.7 mm to 25 mm. It is noted that naturally occurring fibers, such as cellulose, usually do not require cutting as they are formed at a suitable length. Short fibres can be applied by wetforming or airlaying techniques.

Shortcut fiber—A fiber that has been formed at, or cut to, lengths of generally one millimeter to thirteen millimeters. It is noted that naturally occurring fibers, such as cellulose, usually do not require cutting as they are formed at a suitable length.

Sided nonwoven—A sheet of nonwoven material having different fiber compositions and/or different average fibre lengths on its two opposite surfaces.

Spunlacing—A method of bonding a carded nonwoven web by entangling the fibers of that web about adjacent fibers using a plurality of high pressure fluid streams. The fluid may be water. The nonwoven web is supported on a porous belt or screen to allow the fluid to pass through. A negative pressure (vacuum) is applied to the belt side opposing the nonwoven web to draw water from the web through the belt.

Spunlaid filament—A filament formed by extruding molten thermoplastic materials from a plurality of fine, usually circular, capillaries of a spinneret. The diameter of the extruded filaments is then rapidly reduced as by, for example, educative drawing and/or other well-known spunbonding mechanisms. Spunlaid fibers that are spunbonded are generally substantially continuous with deniers within the range of about 0.1 to 5 or more.

Spunbond nonwoven web—Webs formed (usually) in a single process by extruding at least one molten thermoplastic material as filaments from a plurality of fine, usually circular, capillaries of a spinneret. The filaments are partly quenched and then drawn out to reduce fiber denier and increase molecular orientation within the fiber. The filaments are generally continuous and not tacky when they are deposited onto a collecting surface as a fibrous batt. The spunlaid fibrous batt is then bonded.

Staple fiber—A fiber that has been formed at, or cut to, staple lengths of generally one inch to eight inches (25 mm to 200 mm).

Synthetic fiber—a fiber comprised of manmade material, for example glass, polymer, combination of polymers, metal, carbon, regenerated cellulose or lyocell.

Substantially continuous—In reference to the polymeric filaments of a nonwoven web, it is meant that a majority of the filaments or fibers formed by extrusion through orifices remain as continuous nonbroken filaments as they are drawn and collected on a moving belt or other device. Some filaments may be broken during the attenuation or drawing process, with a substantial majority of the filaments remaining continuous.

Tex—A unit used to indicate the fineness of a filament given by the weight in grams for 1,000 meters of filament. A filament of 1 tex has a mass of 1 gram for 1,000 meters of length.

Thermoplastic polymer—A polymer that is fusible, softening when exposed to heat and returning generally to its unsoftened state when cooled to room temperature. Thermoplastic materials include, for example, polyvinyl chlorides, some polyesters, polyamides, polyfluorocarbons, polyolefins, some polyurethanes, polystyrenes, polyvinyl alcohol, copolymers of ethylene and at least one vinyl monomer (e.g., poly (ethylene vinyl acetates), and acrylic resins.

Thermoset polymer—A polymer that permanently hardens when heated and/or crosslinked.

BRIEF DESCRIPTION OF THE DRAWINGS

Referring now to the drawings wherein like elements are numbered alike in the several Figures.

DETAILED DESCRIPTION

Figure 1:
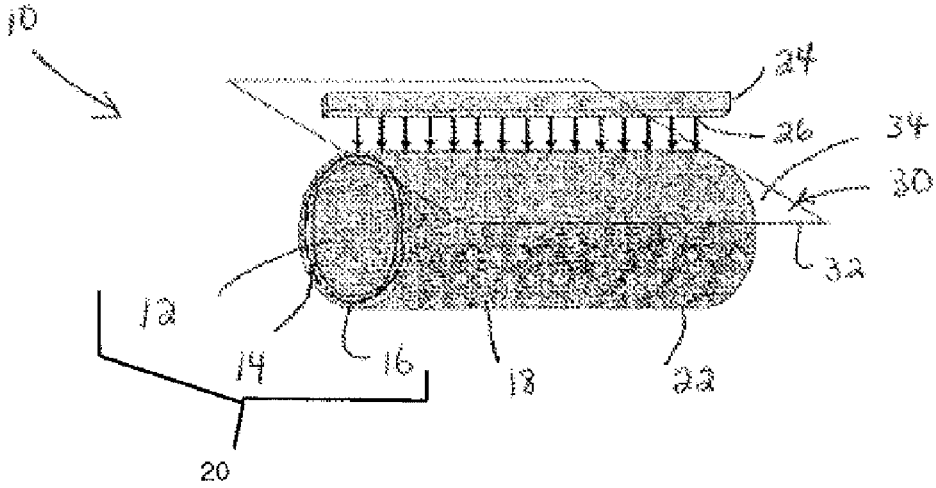
FIG. 1 is a schematic illustration of a preferred embodiment of a patterning apparatus.

A patterned nonwoven with enhanced thickness, softness and/or drape is obtained using the processing methods described herein. Nonwovens with a distinct surface pattern also are obtained.

A preferred nonwoven in accordance with the present invention comprises a thermoplastic web of continuous filaments and short fibers integrated into and overlying the thermoplastic web. Nonwoven materials produced by the methods described herein are sided products. The nonwoven is patterned due to the movement of short fibers and continuous filaments by a set of water needle jets pushing fibers toward the patterned support, and by the reflection of the water as it is repelled off of the patterned support.

Another preferred nonwoven in accordance with the present invention comprises a web of hydroentangled staple fibers and short fibers integrated into and overlying the entangled staple fiber web. Nonwoven materials produced by the methods described herein are sided products. The nonwoven is patterned due to the movement of short fibers and entangled staple fibers by a set of hydraulic needle jets pushing fibers toward the patterned support, and by the reflection of the water as it is reflected off of the patterned support.

Yet another nonwoven in accordance with the present invention comprises a first set of short fibers integrated into a web formed from a second set of short fibers. The second set of short fibers has an average fiber length at least twice the average fiber length of the first set of fibers. The nonwoven is patterned due to the movement of short fibers and entangled staple fibers by a set of hydraulic needle jets pushing fibers toward the patterned support, and by the reflection of the water as it rebounds off the patterned support. Nonwoven materials produced by the methods described herein are sided products.

The patterning process is useful with nonwoven materials having basis weights from about 7 gsm to about 300 gsm.

Some suitable composite nonwoven materials are described in U.S. patent application Ser. No. 10/169,682, the contents of which are incorporated by reference herein in their entirety. More particularly, the filaments generally comprise man-made filaments, in particular substantially continuous filaments, and also can be naturally occurring filaments. Synthetic filaments typically are made of a thermoplastic material, for example a polyamide, polyurethane, polyester, polylactic acid (PLA), or polyolefin, or a copolymer, e.g. block copolymer, containing olefin monomer units. The filaments may also comprise, or consist of, bi-component or bi-constituent or mixed filaments or fibers. Suitable thermoplastic filamentary materials are disclosed in U.S. Pat. No. 5,151,320 and U.S. Pat. No. 5,573,841. Man-made cellulosic fibers, such as viscose rayon or lyocell fibers, may also come into consideration.

If long fibers are used, they typically would be synthetic fibers formed from the materials used to make substantially continuous filaments, or naturally occurring fibers, including but not limited to wool and/or cellulose fibers such as cotton.

Composite nonwovens comprising a web of hydroentangled staple fibers and short fibers integrated into and overlying the entangled staple fiber web are described in U.S. Pat. No. 3,485,706, the contents of which are incorporated by reference herein in their entirety. Mixtures of filaments or fibers of different materials, e.g., different thermoplastic materials can be used. Furthermore, the presence of other, non-interfering components is not precluded.

The short fibers may be synthetic, or may be derived from a wide range of naturally occurring sources of cellulose fibers, such as wood pulp fibers (including hardwood pulp, soft wood pulp and mixtures thereof), although non-wood vegetable pulp fibers such as those derived from cotton, flax, sisal, hemp, jute, esparto grass, bagasse, straw and abaca fibers may also come into consideration. Mixtures of various cellulose pulp fibers may also be used. Mixtures of cellulose fibers and man-made fibers also come into consideration. The cellulose pulp fibers, which may be used, include conventional papermaking fibers, particularly having a fiber length of 6 mm or less. The average fiber length is typically greater than 0.7 mm and is usually from about 1.5 to 5 mm. Conventional papermaking fibers include wood pulp fibers produced by either chemical digestion of wood (the well-known Kraft process), or by mechanical disintegration, or by a combination of the two aforementioned methods (i.e. CTMP, chemi thermo-mechanical pulp). The short fibers may also comprise synthetic or other man-made fibers, for example in an amount of up to 50 percent by weight of the total fiber content of the cellulose fiber-containing web based on economic considerations. Synthetic or man-made fibers can be added in greater amounts to achieve other desired properties. Such man-made fibers include, for example, fibers made of cellulose, polyester, polylactic acid (PLA), polyolefin (e.g., polyethylene or polypropylene), polyamide (e.g., a nylon), rayon, lyocell or the like. Suitable man-made fibers include those having a fiber length of from about 0.7 to 25 mm and a denier per filament of about 1.0 to about 6.0 (0.11 to 0.67 tex).

A third preferred patterned nonwoven in accordance with the present invention may also be produced by applying the reflective patterning technique to a wet laid paper or nonwoven web. The wetlaid web may comprise of a single layer consisting of papermaking pulp fibers (one or more types), and optionally, a percentage of man-made short fibers (0.7 to 25 mm in length). The wetlaid web may also comprise of two or more layers, each layer consisting of papermaking pulp fibers (one or more types), and optionally, a percentage of man-made short fibers (0.7 to 25 mm in length). In multilayer webs, the type and percentage of fibers in each layer may be the same, or may be different from the other layer(s). In multilayer webs, the basis weight of each layer may be the same or may be different from the other layer(s).

For simplicity, reference will be made to such an embodiment of a reflectively patterned composite nonwoven material that comprises a plurality of short fibers overlying and hydraulically needled into a nonwoven web comprising substantially continuous thermoplastic filaments. However, it should be understood that this disclosure encompasses also other patterned, sided nonwoven materials.

The fiber denier is independently chosen for each portion of the patterned composite nonwoven material. The fiber denier for the substantially continuous thermoplastic filaments will be in the range of about 0.1 to about 45 advantageously in the range of about 0.5 to about 30 and typically in the range of about 0.8 to about 10. The nonwoven web comprising substantially continuous thermoplastic filaments will have a basis weight in the range of about 5 gsm to about 100 gsm and an advantageous basis weight in the range of about 8 gsm to about 80 gsm and a typical basis weight in the range of about from 10 gsm to about 70 gsm.

Short fibers useful in the reflectively patterned composite nonwoven material include cellulose fibers, such as wood pulp, and synthetic fibers. The nonwoven web comprising substantially short fibers used in the reflectively patterned composite nonwoven material will have a basis weight of, in general, from about 5 gsm to about 100 gsm, advantageously from about 10 gsm to about 80 gsm and typically from about 20 gsm to about 60 gsm. Often, the short fibers have lengths in the range of 0.7 mm to 25 mm, or 1 mm to 12 mm or 2 mm to 6 mm.

Advantageously, the short fibers are entirely, or substantially entirely, cellulose fibers. The cellulose fibers may be derived from a wide range of naturally occurring sources of cellulose fibers, and are advantageously wood pulp fibers (including hardwood pulp, soft wood pulp and mixtures thereof), although non-wood vegetable fibers such as those derived from cotton, flax, sisal, hemp, jute, esparto grass, bagasse, straw and abaca fibers may also come into consideration. Mixtures of various cellulose fibers may also be used.

The cellulose pulp fibers, which may be used, include conventional short papermaking fibers, particularly having a fiber length of about 0.7 mm to about 6 mm. The average fiber length is advantageously from about 1.5 mm to about 5 mm.

The nonwoven may optionally contain one or more independently selected processing additives, including, for example, coloring pigments, opacifying pigments, functional additives such as a hydrophilic agents, antistatic agents and mixtures thereof. The cross-sectional shape of the aforementioned fibers is typically round although they can be any shape that is convenient to produce for the intended end use, e.g., round, trilobal, triangular, dog-bone shaped, flat or hollow.

Examples of synthetic fibers include fibers made of cellulose such as rayon and polymers such as polyester, polylactic acid (PLA), polyolefin (e.g., polyethylene or polypropylene), polyamide (e.g., a nylon). Suitable synthetic fibers include those having a fiber denier of about 0.1 to about 45, and an advantageous denier of about 0.5 to about 30 and a typical denier in the range of about 0.8 to about 10.

Typically the substantially continuous filaments are extruded, for example spunlaid or meltspun. The extruded filaments are formed in conventional fashion. Advantageously, the continuous filaments are deposited on a moving forming surface to form a spunlaid web.

If the web is made using long fibers or short fibers that are at least twice as long as the fibers on the short fiber side, the two sets of fibers are typically combined by hydraulic needling.

When continuous filaments are used, short fibers are applied to the spunlaid web, usually as a layer. The short fibers may be applied to the spunlaid web as a pre-formed web or tissue, or may be formed on the existing base sheet, for example by means of a wet-laying or air-laying process. Methods by which cellulose fibers may be applied to a base web material are disclosed in the U.S. Pat. Nos. 5,151,320 and 5,573,841, the contents of each of which are incorporated by reference herein in their entirety.

After the layer of short fibers is applied to the spunlaid web, the two layers are integrated by, for example, pressing or calendaring the composite together or by entangling the cellulose fibers into the spunlaid web. Advantageously, the spunlaid web/short fiber composite is subjected to a hydraulic needling operation to form a nonwoven sheet. Hydraulic needling operations are described in U.S. Pat. Nos. 4,883,709 and 5,009,747, the disclosures of both of which are incorporated herein by reference. The hydraulic needling operation is preferably carried out by passing the spunlaid web/short fiber composite under a series of hydraulic needling manifolds which produce a plurality of fluid streams or jets such that the fluid streams impinge upon the uppermost short fiber containing surface of the composite with sufficient force to cause a proportion of the short fibers to be pushed into and combined with the layer of spunlaid filaments. The fluid jets are preferably jets of an aqueous liquid.

The total energy input provided by the fluid jets may be calculated by the formula.

$$E=0.125YPG/bS$$

Wherein Y=the number of orifices per linear inch of manifold width, P=the pressure in psig (pounds per square inch gauge) (1 psi=0.06895 bar) of liquid in the manifold, G=the volumetric flow in cubic feet per minute (1 cfm=0.028 $m^3$/min) per orifice, S=the speed of the composite sheet under the fluid jets in feet per minute (0.305 m/min) and b=the basis weight of the resulting hydraulically needled composite sheet produced in ounces per square yard (1 osy=33.9 gsm). The total amount of energy, E, expended in treating the composite sheet is the sum of the individual energy values for each pass under each manifold, if there is more than one manifold and/or if there is more than one pass. In general, the total energy input is from 0.07 to 0.4 horsepower-hours per pound (HPhr/lb) (0.41 to 2.37 MJ/kg). Preferably, however, the total energy input is from 0.1 to 0.3 HPhr/lb (0.59 to 1.78 MJ/kg), more preferably from 0.12 to 0.28 HPhr/lb (0.71 to 1.66 MJ/kg). The hydraulically needled composite material may be partially or fully dried using conventional drying processes. The hydraulically needled composite material is a sided product with one side comprising predominately substantially continuous thermoplastic filaments and the other side comprising predominately short fibers.

In order to reflectively pattern the nonwoven, the hydraulically needled composite material passes between fluid streams from one or more hydraulic needling manifolds and a support. The nonwoven sheet may be either wet or dry before patterning takes place. The support has a pattern engraved or recessed into the support surface. The support may be, for example, a belt or a roll as illustrated in FIGS. 1 to 5. The support is advantageously non-draining and substantially non-porous so that any fluid impinging the support is reflected away from the support and is directed back into the opposing side of the composite material.

FIG. 1 shows a roller assembly 10 according to a first preferred embodiment of the present invention. The assembly 10 includes a patterned roller 20 having a plurality of recesses 22 on the outer surface thereof, and a hydraulic needling manifold 24. The patterned roller 20 includes a solid or hollow inner cylindrical core 12, an intermediate layer 14 and an outer layer 16 having a plurality of apertures 18 formed therein. Liquid is unable to pass through the apertures 18 because of the presence of the intermediate impervious layer 14. The apertures 18 of the outer layer 16 in combination with the underlying rubber layer 14 form the plurality of recesses 22 in the outer surface of the patterned roller 20. The combination of the impervious layer 14 and the apertured outer layer 16 together form a surface with a plurality of shallow recesses.

A hydraulic needling manifold 24 producing a plurality of fine fluid jets 26 is disposed above the patterned roller 20. A segment of nonwoven material 30 (wet or dry) passes over the top of patterned roller 20. The roller assembly is configured to receive sheets or rolls of nonwoven material 30 between the patterned roller 20 and the hydraulic needling manifold 24. The roller 20 rotates with a certain circumferential speed. The nonwoven web passes over the roller 20 with a linear speed about the same as the roller's circumferential speed, and in the same direction. If desired, the roller's circumferential speed may be varied in the range from −20% to +20% relative to the nonwoven's linear speed. The hydraulic needling manifold 24 project needle jets 26 of water or of other suitable liquid toward the nonwoven material 30, resulting in patterning of at least the lower surface 32 of the material 30. Depending on the depth and shape of the recesses 22, the pressure of the needle jets of water projected from the hydraulic needling manifolds 26, and the basis weight and composition of the nonwoven material, the pattern may also be visible on the upper surface 34 of the nonwoven material 30.

Figure 2:
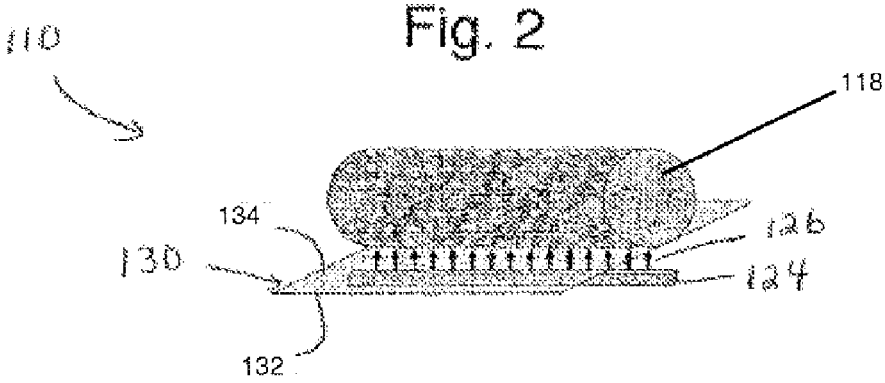
FIG. 2 is a schematic illustration of another preferred embodiment of a patterning apparatus.

FIG. 2 shows a roller assembly 110 that is similar to that of FIG. 1 except that the hydraulic needling manifold 124 is located beneath the patterned roller 118 and the hydraulic needling manifold 124 project needle jets 126 of injector fluid upward toward the lower surface 132 of the nonwoven material 130, resulting in patterning of at least the upper surface 134 of the material 130. Depending on the depth and shape of the recesses in the surface of the roller 118, the pressure of the water needle jets from the hydraulic needling manifolds 126, and the basis weight and composition of the nonwoven material, the pattern may also be visible on the lower surface 132 of the nonwoven material 130. The roller 118 rotates with a certain circumferential speed. The nonwoven web passes the roller assembly with a linear speed about the same as the roller's circumferential speed, and in the same direction. If desired, the roller's circumferential speed may be varied in the range from −20% to +20% relative to the nonwoven's linear speed.

Figure 3:
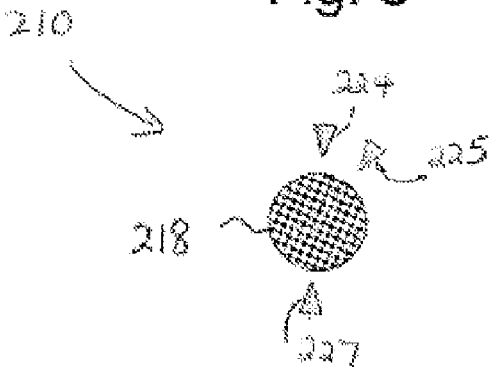
FIG. 3 is a schematic illustration of yet another preferred embodiment of a patterning apparatus.

FIG. 3 shows a roller assembly 210 with three hydraulic needling manifolds 224, 225 and 227. A first upper hydraulic needling manifold 224 is disposed above the patterned roller 218. A lower hydraulic needling manifold 227 is disposed below the patterned roller 218, and a second upper hydraulic needling manifold 225 is disposed beside the first upper hydraulic needling manifold 224. Hydraulic needling manifold 224 and 225 each can be used alone, or can be used simultaneously. Hydraulic needling manifold 227 can be used in combination with hydraulic needling manifold 224 and/or hydraulic needling manifold 225 if additional hydraulic jet treatment is desirable. The rotational speed of the roller relative to the linear speed of the nonwoven is maintained in the range −20% to +20%, as mentioned previously.

Figure 4:
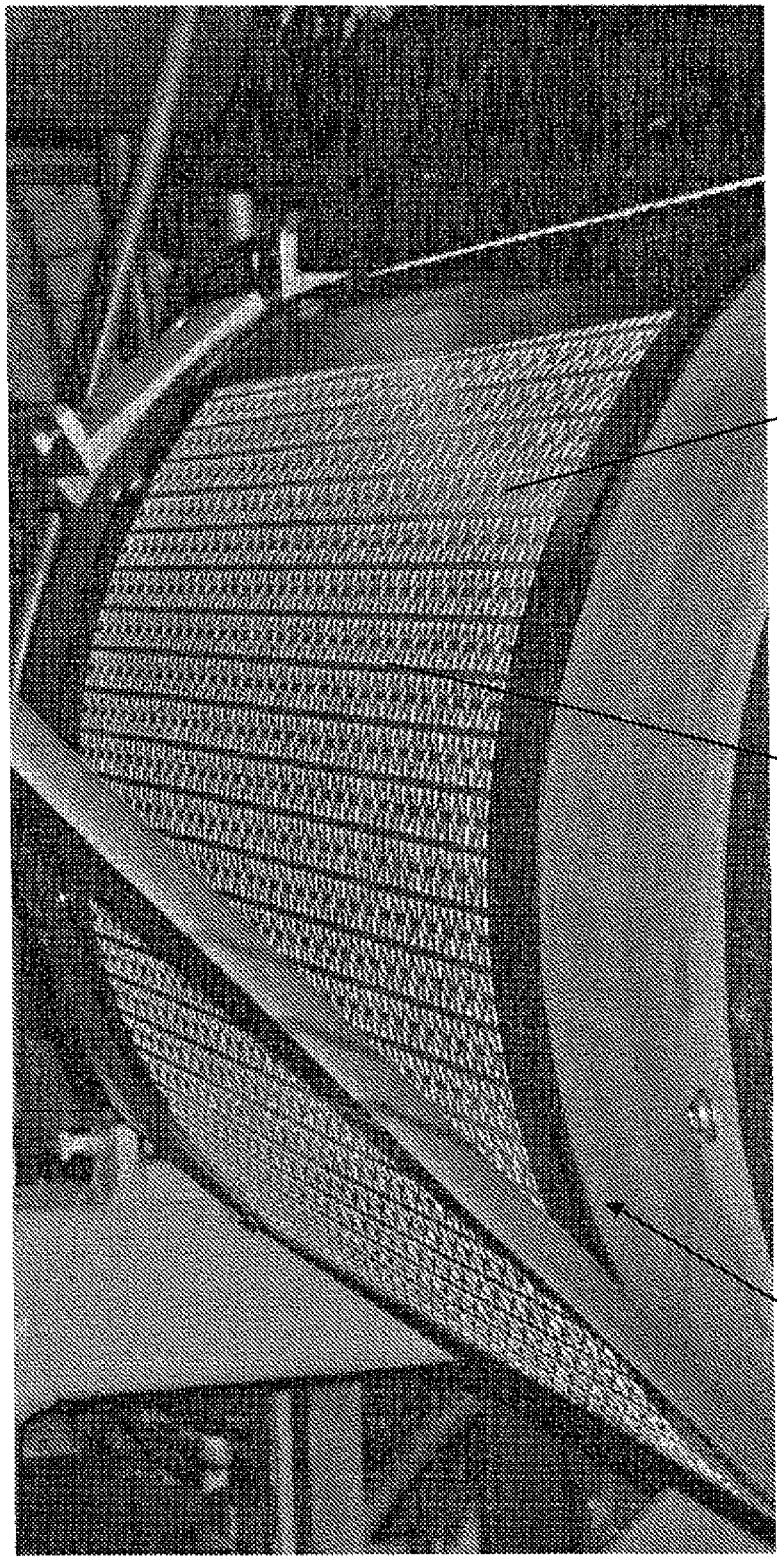
FIG. 4 shows an embodiment of a couch roll configured for patterning.
Figure 5:
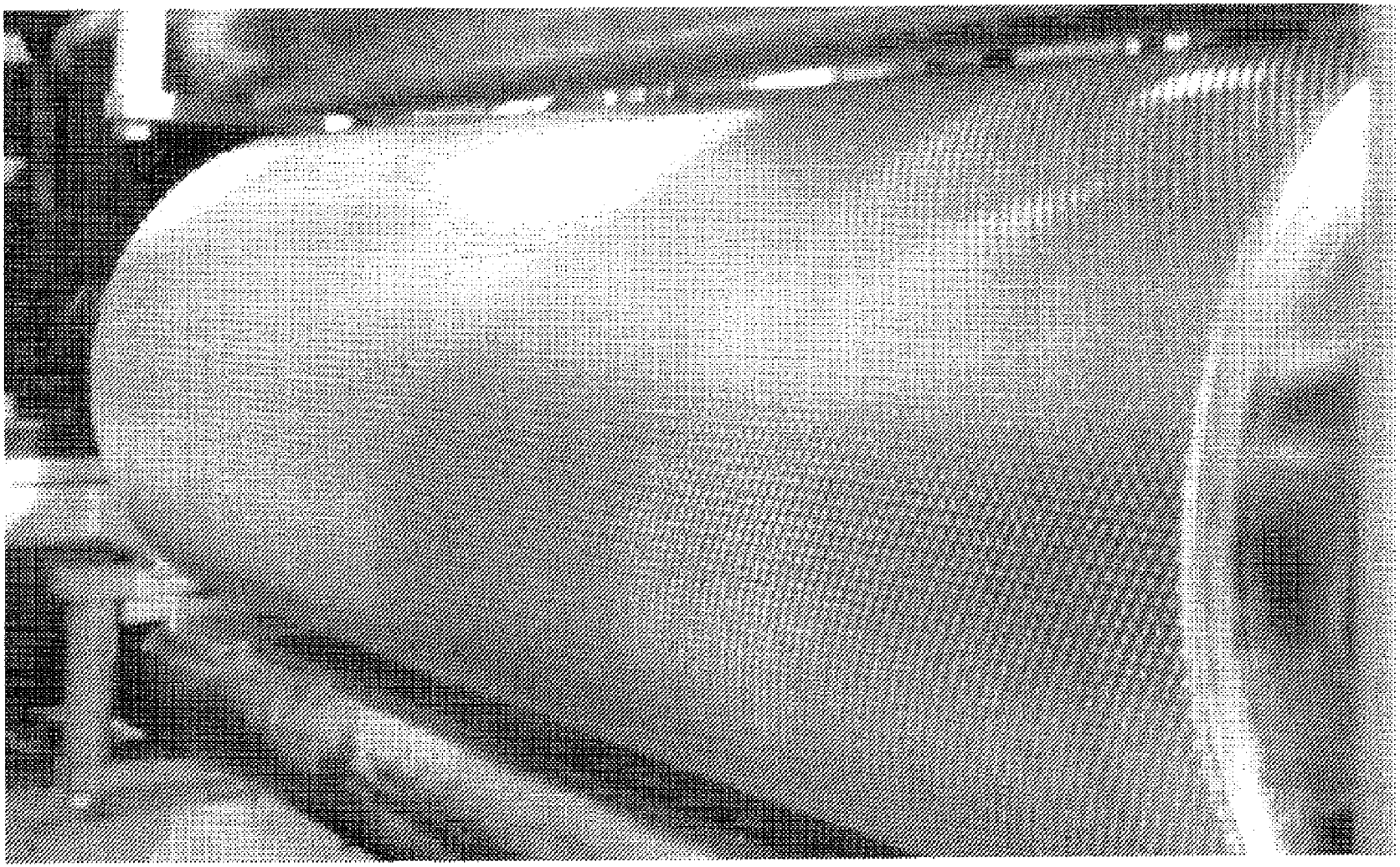
FIG. 5 is an illustration of a roll engraved for patterning with a dot pattern.

FIG. 4 shows a patterned roller 260 having alternating transverse recessed ribs 262 and rows 264 of small circular recesses. FIG. 5 shows a patterned roller 270 with a dot pattern on its outer surface. It is noted that the rollers either can be constructed with an outer layer having apertures which together with an underlying layer form recesses, or can be constructed with an outer layer having recesses formed in its outer surface. When the outer layer has recesses formed therein, it is advantageous but not necessary to form the support from metal. The support has a plurality of recessed areas engraved therein. The patterned roller may be either solid or a hollow shell. The patterns useful in the support are not known to be limited and may be chosen to provide desired fluid reflectivity and aesthetic features to the reflectively patterned nonwoven material.

Figure 6:
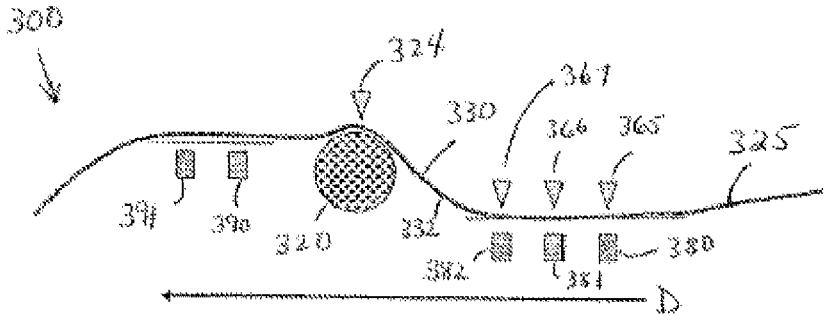
FIG. 6 schematically shows a patterning system with a top hydraulic needling manifold and including upstream hydraulic needle jets.

FIG. 6 illustrates a patterning system 300 in which hydraulic needling equipment is positioned immediately upstream from a patterned roller 320. In this system, the nonwoven material moves generally in the direction shown by arrow D. A sheet of substantially continuous filaments is obtained and combined with short fibers. The short fibers may be deposited on to the filament sheet, or may be applied as a preformed web that is combined with the continuous filament web to form a preliminary sheet 325. The preliminary sheet 325 is subjected to a water jet process to form a hydraulically needled nonwoven web 330 in the form of a sheet using a set of injector jets from hydraulic needling manifolds 365, 366 and 367, as is shown in FIG. 6. Vacuum boxes 380, 381 and 382 are employed beneath the hydraulic needling manifolds 365, 366 and 367, respectively. The hydraulically needled nonwoven web 330 is then passed over a patterned roll 320 and is contacted with fluid from a hydraulic needling manifold 324 producing a plurality of needle jets of water (not shown). Vacuum boxes 390 and 391 are used after the roll 320 in order to remove excess fluid. The hydraulically needled and patterned web is then dried. The lower material surface 332, which is rich in continuous filaments, is adjacent the roll 320.

Figure 7:
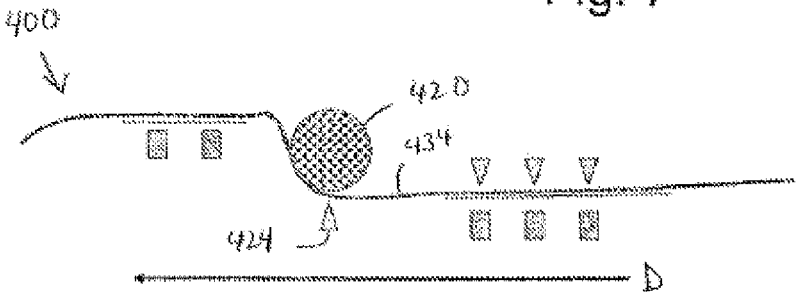
FIG. 7 schematically shows a patterning system with a bottom hydraulic needling manifold bar and including upstream hydraulic needle jets.

The patterning system 400 shown in FIG. 7 is similar to that of FIG. 6 except that the hydraulic needling manifold 424 for patterning the nonwoven is positioned beneath the patterned roller 420 and thus the surface of the nonwoven that is closest to the patterned roller 420 is the upper surface 434 which is rich in short fibers.

In the embodiments described above, the hydraulic needling manifolds are positioned facing the support so that fluid expelled from the hydraulic needling manifolds is directed through one side of the nonwoven material to impinge on the patterned support. The hydraulic needling manifold position with respect to the support is not critical and hydraulic needling manifolds can be mounted in any position with respect to the support as allowed by the available equipment and required to achieve a desired energy input. The patterning process uses fluid under high pressure to provide a high energy input to the hydraulically needled composite material.

In most cases, the impinging fluid is reflected from the patterned support and directed back into the opposing side of the hydraulically needled composite material. In preferred embodiments, no negative pressure (vacuum) is applied to the hydraulically needled composite material during the reflective patterning process so that the amount of fluid being reflected off of the support and into the opposing side of the hydraulically needled composite material can be maximized. Use of a non-draining and/or non-porous support is advantageous to maximize reflection of the fluid off of the support and into the opposing side of the hydraulically needled composite material. A reflective patterning process moves the short fibers and the substantially continuous filaments both when the reflective patterning hydraulic needling jets initially impact the composite material and when the fluid is reflected off of the patterned support.

The patterned nonwoven composite material is dried using conventional drying processes.

The reflectively patterned nonwoven composite material can have a visual and tactile appearance ranging from an imaged pattern of opaque and/or translucent regions with little to no tactile texture to a fully textured surface depending on the support pattern and the hydraulic energy imparted by the hydraulic needling manifold. The reflectively patterned nonwoven composite material may become softer than the precursor-hydraulically needled composite material. The material may have a greater thickness than the precursor hydraulically needled material. For example, thickness can be increased by at least 5%, at least 10%, or more. In this context, the term drapeability indicates a relative softness. In some cases, the reflectively patterned nonwoven composite is more drapeable than the precursor hydraulically needled composite material. For example, drapeability can be improved by 50% or more, or 100% or more. The reflectively patterned nonwoven composite material can have a distinct pattern. As mentioned earlier, the pattern can be a visual image of opaque and translucent regions and/or be a textured surface.

The following examples are included for purposes of illustration so that the disclosure may be more readily understood and are in no way intended to limit the scope of the disclosure unless otherwise specifically indicated.

EXAMPLES 1-3 AND A

Hydraulically needled composite material A was used as a precursor material for samples 1 to 3. Hydraulically needled composite material A comprised a short fiber blend of 85% pulp fiber and 15% thermoplastic, bicomponent shortcut fiber which was hydraulically needled into a substantially continuous thermoplastic filament web. The hydraulically needled nonwoven composite had a basis weight of about 56 gsm. The short fiber blend comprised 42 gsm and the filaments comprised 14 gsm. The hydraulically needled composite material was a sided product with one side comprising predominately all substantially continuous thermoplastic filaments and the other side comprising predominately all short fibers. Hydraulically needled composite material A before reflective patterning had the properties illustrated in Table 2.

A conventional brass cylindrical couch roll 12, shown in FIG. 1, was wrapped with a cylindrical, perforated aluminum sheet 16 to provide a support 20 with a recessed pattern defined by recesses 22. In the initial trials, it was possible to add a rubber sheet 14 between the couch roll 12 and the perforated aluminum sheet 16. Two patterns were evaluated; a Windsor pattern, shown in FIG. 4, and a dot pattern, comprising a series of about 3 mm apertures spaced approximately 1.5 mm apart.

A single hydraulic needling manifold 24 producing a plurality of needle jets of water 26 was mounted just off the couch roll's top-dead-center position. Trials were run using a water pressure of 1100 psi (76 bar).

Sample 1 was made by facing the substantially continuous filament side of material A, i.e. the lower surface 32 shown in FIG. 1 toward the patterned support. Sample 2 was made by facing the pulp-rich, short fiber side of material A toward the patterned support. Sample 3 used the same couch roll and perforated aluminum sheet of Samples 1 and 2 but disposed a rubber sheet 14 between the couch roll 12 and perforated aluminum sheet 16. Process conditions and properties can be found in Tables 1 and 2.

TABLE 1

| Sample | Pattern | Backing | Pattern | Comments |
|---|---|---|---|---|
| 1 | dot | none | medium | filament side toward patterned support, short fiber side toward hydraulic needling manifold |
| 2 | dot | none | good | short fiber side toward patterned support, filament fiber side toward hydraulic needling manifold |

TABLE 1-continued

| Sample | Pattern | Backing | Pattern | Comments |
|---|---|---|---|---|
| 3 | dot | rubber | poor | deep puddle on reel side, pattern destroyed |

Samples 1 to 3 were run at a line speed of 25 meters/min with a hydraulic needling manifold pressure of 1100 psi (76 bar), and using 90μ diameter jet orifices, and a gap of about 6 mm between the hydraulic needling manifold and the couch roll. No negative pressure (vacuum) was used in any of the samples 1 to 3.

TABLE 2

| Property | Units | Sample A | Sample 1 | Sample 2 |
|---|---|---|---|---|
| Basis Weight | gsm | 57 | 59 | 60 |
| Dry Thickness | microns | 540 | 539 | 564 |
| Wet thickness | microns | 447 | 499 | 528.5 |
| % Increase in Wet Thickness | | | 12% | 18% |
| Handle-o-meter (HOM) | | | | |
| MD | grams | 52.4 | 34.1 | 24.5 |
| CD | grams | 25.5 | 13.1 | 8.9 |
| Improved Drapeability | | | 165% | 233% |
| Martindale Abrasion Resistance | Revolutions (average) | 15.5 | 9.5 | 15.5 |

As is shown in Table 2, the wet thickness of the patterned samples, Samples 1 and 2, was greater than that of the control, Sample A.

The Handle-o-Meter (HoM) instrument is available from Thwing-Albert Instrument Co. Handle-o-meter (HoM) measures the force (in grams) required to push a fabric into a slot opening. High values of applied force indicate a non-flexible, stiff test sample, and conversely lower force values indicate more flexible, softer test samples. Drapeability is a descriptive term indicating relative fabric softness. A Handle-o-Meter test on a soft, drapeable test sample will result in a low measured force. Drapeability is usually measured by testing the fabric both in the Machine Direction (MD), and in the Cross Direction (CD). Handle-o-Meter tests were conducted in accordance with TAPPI test method T498.

The improvement in drapeability of the samples was calculated by the following method:

$$\text{Drapeability Improvement (\%)} = \frac{(HoM_{MD,original} + HoM_{CD,original})}{(HoM_{MD,patterned} + HoM_{CD,patterned})} \times 100$$

It is theorized that sample 2 had improved thickness and drapeability as compared to sample 1 due to ease of movement of the short fibers facing the patterned impermeable support as compared to the continuous filaments facing the patterned impermeable support.

EXAMPLES 4-20

A set of examples were conducted in which a sheet of substantially continuous filaments was obtained and combined with short fibers in a hydraulic needling process to form a composite sheet using the system shown in FIGS. 6 and 7. Vacuum boxes were employed beneath the three hydraulic needling manifolds. The first set of examples, for which data is shown on Table 3, used a nonwoven containing 70 wt % short pulp fibers and 30 wt % continuous fibers. The second set of examples, for which data is shown on Table 4, used a nonwoven containing 70 wt % short fibers, of which 4/5 by weight were pulp fibers and 1/5 by weight were polyester fibers. The third set of examples, for which data is shown on Table 5, contained 70 wt % short fibers and 30 wt % continuous fibers. The following parameters were used:

1) Trials were run at 30-35 ft/min (0.15-0.18 m/s)
2) Most trials were run with a hydraulic needling pressure of 1000-1100 psi (69-76 bar) to combine the short fiber layer with the continuous filament web. Water was used as the fluid.
3) At the patterning stage, hydraulic needling manifold pressures ranged from 300-1000 psi (21-69 bar). Water was used as the fluid.
4) In some cases, the material went over the patterning roller and in other cases the material went under the patterning roller. In the data on the Tables, Path A corresponds to FIG. 6 and Path B corresponds to FIG. 7.

The resulting sheets were tested for thickness, patterning/texture and Handle-o-Meter readings.

TABLE 3

| | | Material Description: Pulp/continuous filament Sample ID: | | | | | |
|---|---|---|---|---|---|---|---|
| | | Sample 4 | Sample 5 | Sample 6- 2 hydraulic needling manifolds | Sample 7-300 | Sample 8 - 400 | Sample 9-500 |
| Hydraulic needling manifold pressure #1-3 | psi/bar | 1000/68.9 | 1000/68.9 | 1000/68.9 | 1000/68.9 | 1000/68.9 | 1000/68.9 |
| Patterning pressure | psi/bar | — | 1000/68.9 | 1000/68.9; 1000/68.9 | 300/20.7 | 400/27.6 | 500/34.5 |
| | | not used | Path A | Path A | Path B | Path B | Path B |
| | Side facing | pattern roll | CTF | CTF | Pulp | Pulp | Pulp |
| Basis Weight | g/m2 | 64 | 63 | 64.5 | 65 | 61 | 63 |
| Thickness - Dry | microns | 540 | 611 | 645 | 574 | 614 | 688 |
| Increase in dry thickness | | | 13% | 19% | 6% | 14% | 27% |
| Thickness - Wet | microns | 485 | 545 | 581 | 546 | 572 | 563 |
| Increase in wet thickness | | | 12% | 20% | 13% | 18% | 16% |
| Handleometer - MD | g | | 56.35 | 64 | 82.07 | 58 | 61.05 |
| Handleometer - CD | g | | 16.25 | 15.32 | 14.27 | 13.72 | 12.52 |
| Texture & Pattern Rank* | Dry | 1 | 1 | 1.5 | 1 | 2 | 3 |
| | Wet | 1 | 1 | 1 | 1 | 2 | 3 |

CTF—continuous filament

*Values 1 through 4 for the texture/pattern rank indicate poor, fair, good and excellent respectively.

TABLE 4

| | | Material Description: Pulp/6 mm 1.5 dpf PET fiber/continuous filament Sample ID: | | | | |
|---|---|---|---|---|---|---|
| | | Sample 10 | Sample 11-300 | Sample 12-1000 | Sample 13-300 | Sample 14-500 |
| Hydraulic needling manifold pressure #1-3 | psi/bar | 1000/68.9 | 1000/68.9 | 1000/68.9 | 1000/68.9 | 1000/68.9 |
| Patterning pressure | psi/bar | — | 300/20.7 | 1000/68.9 | 300/20.7 | 500/34.5 |
| | | not used | Path A | Path A | Path B | Path B |
| | Side facing pattern roll: | | CTF | CTF | Pulp | pulp |
| Basis Weight | gsm | 56 | 55 | 55 | 55 | 55 |
| Thickness - Dry | microns | 544 | 490 | 574 | 544 | 650 |
| Increase in dry thickness | | | −10% | 6% | 0% | 20% |
| Thickness - Wet | microns | 496 | 450 | 541 | 487 | 550 |
| Increase in wet thickness | | | −9% | 9% | −2% | 11% |
| Handleometer - MD | g | 18.4 | 26.7 | 30.0 | 23.0 | 30.9 |
| Handleometer - CD | g | 6.8 | 7.9 | 8.0 | 9.8 | 11.5 |
| Texture & Pattern Rank | Dry | 1 | 1 | 1 | 2 | 4 |
| | Wet | 1 | 1 | 1 | 1 | 3 |

CTF—continuous filament

TABLE 5

| | | Material Description: Pulp/continuous filament ID Number: | | | | | |
|---|---|---|---|---|---|---|---|
| | | Sample 15 | Sample 16-300 | Sample 17-1000 | Sample 18-300 | Sample 19-400 | Sample 20-500 |
| Hydraulic needling manifold pressure #1-3 | psi/bar | 1000/68.9 | 1000/68.9 | 1000/68.9 | 1000/68.9 | 1000/68.9 | 1000/68.9 |
| Patterning pressure | psi/bar | — | 300/20.7 | 1000/68.9 | 300/20.7 | 400/27.6 | 500/34.5 |
| | | not used | Path A | Path A | Path B | Path B | Path B |
| | Side facing pattern roll | | CTF | CTF | Pulp | Pulp | pulp |
| Basis Weight | g/m2 | 67.29 | 66.5 | 68 | 63 | 71 | 68 |
| Thickness - Dry | microns | 467 | 528 | 645 | 607 | 652 | 693 |
| Increase in dry thickness | | | 13% | 38% | 30% | 40% | 48% |
| Thickness - Wet | microns | 442 | 460 | 586 | 520 | 594 | 606 |
| Increase in wet thickness | | | 4% | 33% | 18% | 34% | 37% |
| Handleometer - MD | g | 114.5 | 116 | 74 | 108 | 132 | 117 |
| Handleometer - CD | g | 18 | 20 | 21 | 17 | 20 | 12 |
| Texture and Pattern Rank | Dry | 1 | 2 | 2 | 1 | 2 | 3 |
| | Wet | 1 | 1 | 1.5 | 1.5 | 2 | 4 |

CTF—continuous filament

For path B, the maximum hydraulic needling manifold pressure at the hydropatterning roll was 500 psi (35 bar). Pressures above 500 psi (35 bar), would cause removal of the pulp from the pulp-continuous filament composite. Whereas in the previous trial where there was a softening effect in addition to patterning, this softening effect was no longer seen with this one step process. However, significant thickness increases were measured in hydropatterned samples that were patterned using path A and path B. Path B which focused the pulp-rich face toward the recessed roll produced a pattern with raised dots/bumps. A significantly textured surface can be seen and felt. Path A which focused the continuous filament-rich face toward the recessed roll produced a watermark-like pattern. A textured surface could be seen, but not felt.

Figure 8:
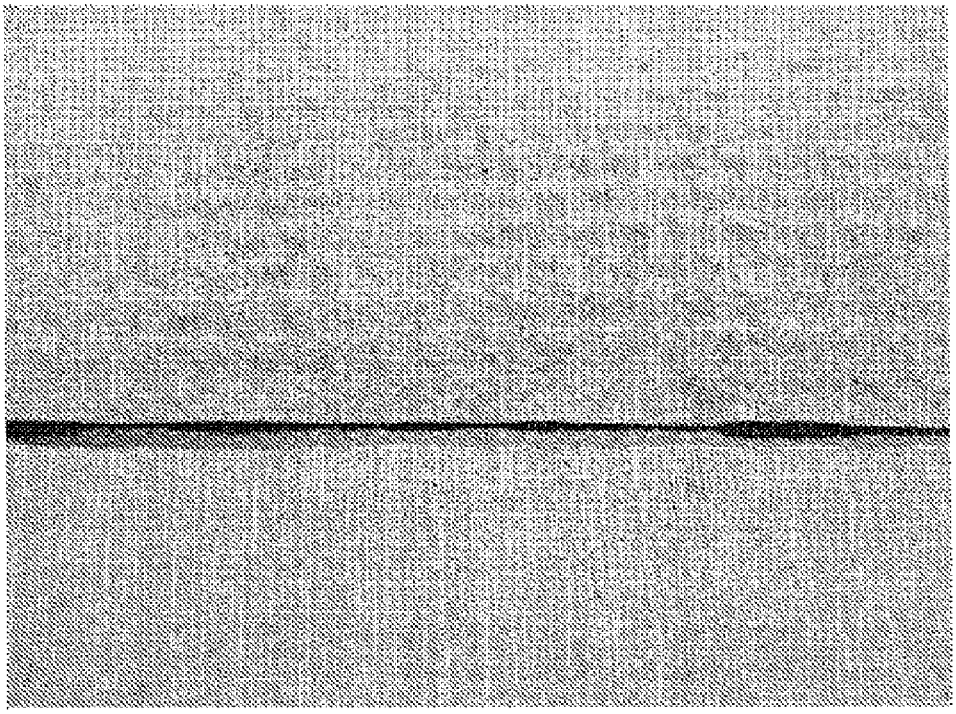
FIGS. 8-10 are photographs showing patterned nonwovens.
Figure 9:
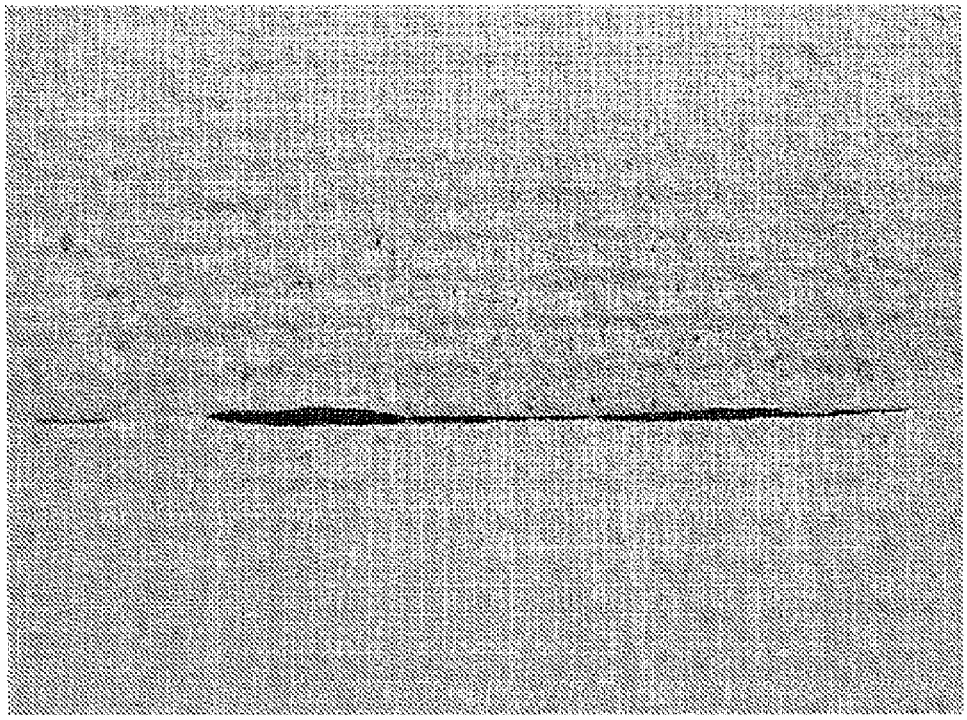
Figure 10:
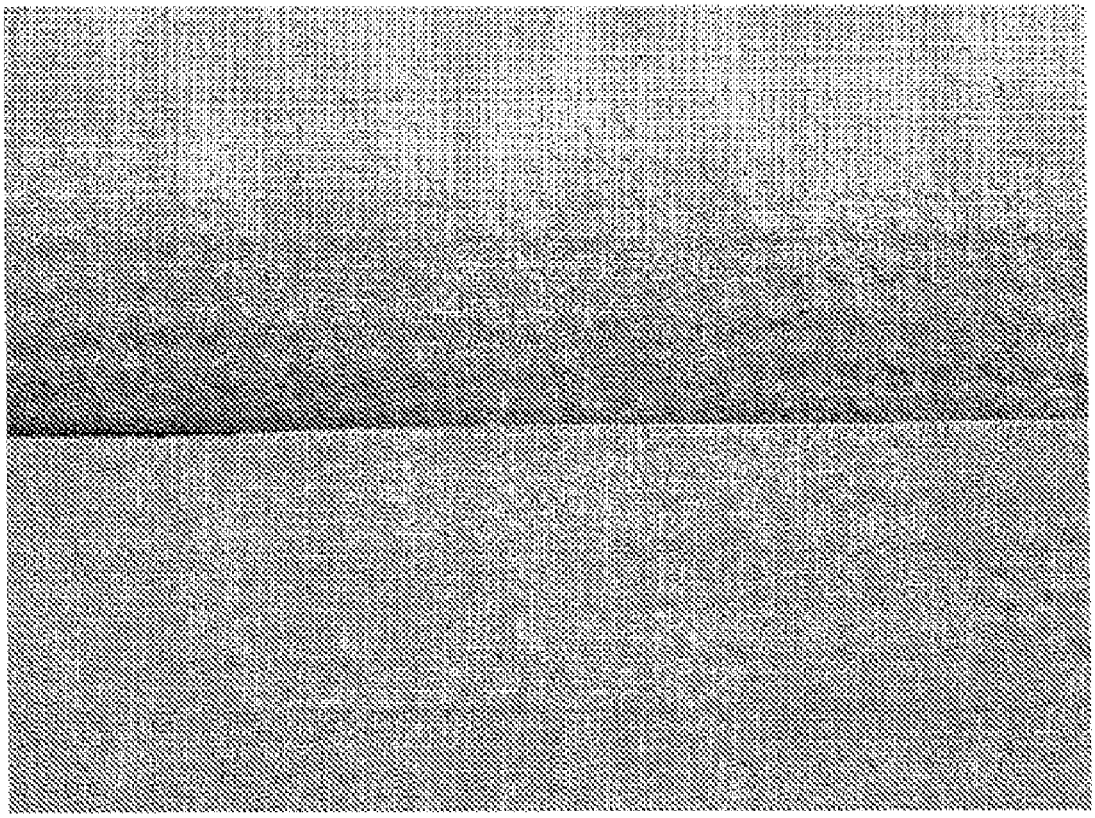

FIGS. 8-10 are photographs showing some of the dry patterned samples. FIG. 8 shows Sample 14 on the top and Sample 12 below. It is noted that the pattern in sample 14, which was made using Path B, is more pronounced than the pattern in Sample 12, which was made using Path A. This occurred even though a greater hydraulic needling pressure was used in the patterning process of Sample 12 than was employed in making Sample 14. When the short fiber side of the sided nonwoven was oriented toward the patterned roll, the short fibers were able to move easily in order to form the patterned surface. On the other hand, when the substantially continuous filaments were oriented toward the patterned roll, the continuous filaments have less ability to move and thus a less pronounced pattern was visible. The same effect is shown in FIG. 10, in which the top Sample is Sample 9 was patterned at a manifold pressure of 500 psi (34.5 bar) (Path B) and the bottom sample, Sample 5, was patterned at a manifold pressure of 1000 psi (68.9 bar) (Path A). FIG. 9 shows Sample 20 at the top and Sample 17 at the bottom. It is noted that the low manifold pressure (300 psi/20.7 bar) patterning of Sample 17 using Path A resulted in a less pronounced pattern than the higher manifold pressure patterning of Sample 20 using Path B.

While preferred embodiments have been set forth for purposes of illustration, the foregoing description should not be deemed a limitation of the disclosure herein. Accordingly, various modifications, adaptations and alternatives may occur to one skilled in the art without departing from the spirit and scope of the present disclosure.

What is claimed is:

1. A method of enhancing softness, drape, and thickness of a patterned nonwoven web, comprising:

providing a sided nonwoven web comprising a first set of fibers hydraulically needled with a web of a second set of fibers, the first set of fibers primarily containing short fibers having a length of 0.7 mm to 25 mm and the second set of fibers primarily containing one of (a) substantially continuous filaments, (b) long fibers, and (c) short fibers having an average fiber length at least twice the average fiber length of the first set of fibers, the sided nonwoven web having a first surface predominately comprising the first set of fibers and an opposing second surface predominately comprising the second set of fibers, disposing the nonwoven web between a surface of a non-porous patterned support and a hydraulic needling manifold so at least one of the first surface and the second surface is orientated toward the hydraulic needling manifold and the other of the first surface and the second surface is orientated toward the support surface, discharging fluid from the hydraulic needling manifold to rearrange fibers on at least one of the first and second surfaces, passing fluid discharged from the hydraulic needling manifold through the nonwoven web to impact the support surface, and patterning the nonwoven web by discharging fluid from the hydraulic needling manifold and impacting the fluid on the non-porous support surface and reflecting the fluid into the surface of the nonwoven web that is oriented toward the non-perforated support surface.

2. The method of claim 1, wherein the first surface containing short fibers is oriented toward the support surface and the other surface containing the second set of fibers is oriented toward the hydraulic needling manifold.

3. The method of claim 1, wherein the second surface is oriented toward the hydraulic needling manifold.

4. The method of claim 1, further comprising:

extruding thermoplastic polymer onto a forming surface to prepare a web of substantially continuous filaments;

applying short fibers having a length of 0.7 mm to 25 mm onto the web to form a layered structure; and impacting the layered structure with a fluid stream so as to hydraulically needle the short fibers with the substantially continuous filaments to form the sided, composite nonwoven web.

5. The method of claim 1, wherein the support surface comprises a plurality of recessed portions.

6. The method of claim 1, wherein the support surface comprises a plurality of recessed portions and comprising providing the first nonwoven web surface with a perceptible texture pattern in portions of the first nonwoven web surface that are adjacent to the support surface recessed portions.

7. The method of claim 1, wherein the support surface comprises a plurality of recessed portions, the pattern on the web corresponding to the recessed portions.

8. The method of claim 1, wherein the fluid is discharged at a pressure of at least 200 psi (14 bar).

9. The method of claim 1, wherein the first set of fibers predominately comprises cellulose fibers.

10. The method of claim 1, wherein the nonwoven web has an improved drapeability of at least 50% as compared to the equivalent non-reflectively patterned nonwoven web.

11. The method of claim 1, wherein the support surface comprises a plurality of recessed portions and the patterned nonwoven web has an increase of wet thickness of at least about 5% in portions of the first nonwoven web surface that were adjacent to the recessed portions as compared to the provided nonwoven web.

12. The method of claim 1, wherein the support surface comprises a plurality of recessed portions and the reflectively patterned nonwoven web has an increase of wet thickness of at least about 10% in portions of the first nonwoven web surface that were adjacent to the recessed portions as compared to the provided nonwoven web.

* * * * *